US011325020B1

(12) United States Patent
McCarthy et al.

(10) Patent No.: US 11,325,020 B1
(45) Date of Patent: May 10, 2022

(54) ELECTRIC SKATEBOARD

(71) Applicant: Milton, LLC, Ponce Inlet, FL (US)

(72) Inventors: Scott McCarthy, Ponce Inlet, FL (US); Logan McCarthy, Ponce Inlet, FL (US)

(73) Assignee: Milton, LLC, Ponce Inlet, FL (US)

( * ) Notice: Subject to any disclaimer, the term of this patent is extended or adjusted under 35 U.S.C. 154(b) by 25 days.

(21) Appl. No.: 17/117,281

(22) Filed: Dec. 10, 2020

(51) Int. Cl.
*A63C 17/12* (2006.01)
*A63C 17/01* (2006.01)

(52) U.S. Cl.
CPC ..... *A63C 17/12* (2013.01); *A63C 17/012* (2013.01); *A63C 17/014* (2013.01)

(58) Field of Classification Search
CPC ..... A63C 17/12; A63C 17/012; A63C 17/014; A63C 17/017
See application file for complete search history.

(56) References Cited

U.S. PATENT DOCUMENTS

| | | | | |
|---|---|---|---|---|
| 1,123,686 | A | 1/1915 | Cole et al. | |
| 4,991,861 | A | 2/1991 | Carn et al. | |
| 7,484,741 | B2 * | 2/2009 | Kay, III | A63C 17/015 280/87.01 |
| 2001/0030404 | A1 | 10/2001 | Liu | |
| 2003/0122334 | A1 * | 7/2003 | Laporte | A63C 17/012 280/87.041 |
| 2004/0155421 | A1 | 8/2004 | Paddock | |
| 2005/0230930 | A1 | 10/2005 | Chung | |
| 2005/0280231 | A1 * | 12/2005 | Gallipoli | A63C 17/015 280/87.042 |
| 2006/0226620 | A1 | 10/2006 | Cole | |
| 2007/0246308 | A1 | 10/2007 | Sauve et al. | |
| 2011/0042913 | A1 * | 2/2011 | Landau | A63C 17/015 267/285 |
| 2013/0175790 | A1 * | 7/2013 | Wurst | A63C 17/16 280/639 |
| 2016/0107070 | A1 * | 4/2016 | Middleton | A63C 17/262 280/87.042 |

(Continued)

FOREIGN PATENT DOCUMENTS

| | | | |
|---|---|---|---|
| DE | 10215278 | A1 | 10/2003 |
| EP | 0933103 | A2 | 8/1999 |

(Continued)

*Primary Examiner* — Brian L Swenson
(74) *Attorney, Agent, or Firm* — Meunier Carlin & Curfman LLC

(57) ABSTRACT

Various implementations include a skateboard truck including a baseplate, a hanger, and a kingpin. The baseplate defines has a mounting surface. The hanger includes a main portion, a pivot pin, a first branch, and a second branch. The pivot pin is disposed within a pivot cup of the baseplate. The kingpin is disposed within openings in the baseplate and hanger. The branches each have curved longitudinal axes, a first portion coupled to the main portion, and a middle portion coupling the first and second portions. The second portion of each of the branches defines an axle opening. The first portion extends from the main portion toward the middle portion in a direction away from a mounting surface plane. The second portion extends from the middle portion in a direction toward the mounting surface plane. The first portions are closer to each other than the second portions are to each other.

42 Claims, 9 Drawing Sheets

(56) References Cited

U.S. PATENT DOCUMENTS

| | | | | |
|---|---|---|---|---|
| 2017/0182398 | A1* | 6/2017 | Garcia Elena | A63C 17/012 |
| 2019/0382072 | A1* | 12/2019 | Allen | A63C 17/012 |

FOREIGN PATENT DOCUMENTS

| | | | |
|---|---|---|---|
| GB | 2426462 | A | 11/2006 |
| WO | 2003095042 | A2 | 11/2003 |
| WO | 2004108231 | | 12/2004 |

* cited by examiner

ELECTRIC SKATEBOARD

BACKGROUND

Traditionally, skateboard trucks are coupled to the bottom surface of a deck of a skateboard and connect two wheels to each end of the deck. Skateboard trucks come in many forms and usually allow some degree of pivoting or flexibility such that a user can control the skateboard in order to control and/or "carve" while riding. The location of the skateboard truck limits the wheel size because it is unsafe/unenjoyable to ride a skateboard that is too high off of the ground. However, small diameter wheels are not able to traverse uneven surfaces as well as larger diameter wheels.

Some current skateboards include axle mounts that extend the axles in front and behind the ends of the board so that larger wheels can be used without raising the height of the board. However, the modifications to the axle mounts needed to extend the wheels beyond the ends of the board result in a skateboard that does not control and/or "carve" like a traditional skateboard.

Electric skateboards generally have the same truck configuration as typical skateboards with the inclusion of an electric motor and a battery. The motors and batteries are typically coupled to the bottom surface of the deck such that the motor and battery extend toward the ground when the skateboard is being ridden. Locating the motors and batteries on the bottom surface of the deck can be problematic in uneven terrain because the undermounted components could contact the ground, causing damage to the components or causing the rider to fall.

Thus, a need exists for an electric skateboard that controls like a traditional skateboard, allows for a smoother ride on uneven surfaces, and includes the motor and battery in a less obtrusive configuration.

SUMMARY

Various implementations include a truck configured to be used with a skateboard. The truck includes a baseplate, a hanger, a kingpin, and at least one bushing. The baseplate has a mounting surface and defines a pivot cup and a first opening. The mounting surface defines one or more fastener openings. The hanger includes a main portion, a first branch, and a second branch. The main portion includes a pivot pin and defines a second opening. At least a portion of the pivot pin is disposed within the pivot cup. The first branch and a second branch each have a separate curved longitudinal axis, a first portion coupled to the main portion, a second portion opposite the first portion, and a middle portion disposed between the first and second portions. The second portion of each of the first and second branches defines an axle opening. The axle openings of the first and second branches are aligned with each other. The first portion initially extends from the main portion toward the middle portion in a first direction having a vector component directed away from a plane defined by the mounting surface. The second portion initially extends from the middle portion in a second direction having a vector component directed toward the plane defined by the mounting surface. The first portions are closer to each other than the second portions are to each other. The kingpin is disposed within the first and second openings and couples the main portion to the baseplate. The at least one resilient bushing is disposed along the kingpin.

In some implementations, the axle openings are disposed opposite the plane defined by the mounting surface from the middle portion. In some implementations, the axle openings are aligned with the plane defined by the mounting surface.

In some implementations, a brace extends between the middle portions of the first and second branches.

In some implementations, the at least one bushing includes a first bushing and a second bushing. The first bushing is disposed along the kingpin between the main portion and the baseplate. The second bushing is disposed along the kingpin adjacent a surface of the main portion opposite the first bushing.

In some implementations, the truck further includes a shock absorber.

In some implementations, the baseplate and hanger comprise metal. In some implementations, wherein the metal comprises aluminum.

In some implementations, the at least one bushing comprises a polymer.

In some implementations, the at least one of the first branch and the second branch is hollow for extending wire therethrough.

Various other implementations include a skateboard including at least one truck, a board, and a wheel. The at least one truck includes a baseplate, a hanger, a kingpin, and at least one bushing. The baseplate has a mounting surface and defines a pivot cup and a first opening. The mounting surface defines one or more fastener openings. The hanger includes a main portion, a first branch, and a second branch. The main portion includes a pivot pin and defines a second opening. At least a portion of the pivot pin is disposed within the pivot cup. The first branch and a second branch each have a separate curved longitudinal axis, a first portion coupled to the main portion, a second portion opposite the first portion, and a middle portion disposed between the first and second portions. The second portion of each of the first and second branches defines an axle opening. The axle openings of the first and second branches are aligned with each other. The first portion initially extends from the main portion toward the middle portion in a first direction having a vector component directed away from a plane defined by the mounting surface. The second portion initially extends from the middle portion in a second direction having a vector component directed toward the plane defined by the mounting surface. The first portions are closer to each other than the second portions are to each other. The kingpin is disposed within the first and second openings and couples the main portion to the baseplate. The at least one resilient bushing is disposed along the kingpin. The board has a longitudinal axis, a top surface, a bottom surface opposite and spaced apart from the top surface, a first end, and a second end opposite and spaced apart from the first end along the longitudinal axis. The at least one truck is coupled to the top surface of the board adjacent either the first end or the second end of the board such that the mounting surface abuts the top surface of the board. The wheel has a central axis and is disposed between the second portions of the first and second branches such that the central axis is aligned with the axle openings.

In some implementations, the axle openings are disposed opposite the plane defined by the mounting surface from the middle portion.

In some implementations, the axle openings are aligned with the plane defined by the mounting surface.

In some implementations, a brace extends between the middle portions of the first and second branches.

In some implementations, the at least one bushing includes a first bushing and a second bushing. The first bushing is disposed along the kingpin between the main portion and the baseplate. The second bushing is disposed along the kingpin adjacent a surface of the main portion opposite the first bushing.

In some implementations, the at least one truck further comprises a shock absorber.

In some implementations, the baseplate and hanger comprise metal. In some implementations, the metal comprises aluminum.

In some implementations, the at least one bushing comprises a polymer.

In some implementations, at least one of the first branch and the second branch is hollow for extending wire therethrough.

In some implementations, the wheel includes motor.

In some implementations, the skateboard further includes a battery which is in electrical communication with the motor. In some implementations, the battery is disposed on the bottom surface of board.

In some implementations, the top surface of the board includes a frictional coating.

In some implementations, the at least one truck further includes two trucks. Each of the two trucks has a wheel having a central axis with the wheel being disposed between the second portions of the first and second branches of each truck such that the central axis of each of the wheels is aligned with the axle openings of the first and second branches of its respective truck.

In some implementations, the skateboard further includes a Bluetooth control system for controlling the motor.

In some implementations, the board further includes foot straps coupled to the top surface.

In some implementations, the wheel has a diameter in the range of 10-13 inches.

In various other implementations include a system configured to be used with a skateboard that includes a truck and a wheel. The truck includes a baseplate, a hanger, a kingpin, and at least one bushing. The baseplate has a mounting surface and defines a pivot cup and a first opening. The mounting surface defines one or more fastener openings. The hanger includes a main portion, a first branch, and a second branch. The main portion includes a pivot pin and defines a second opening. At least a portion of the pivot pin is disposed within the pivot cup. The first branch and a second branch each have a separate curved longitudinal axis, a first portion coupled to the main portion, a second portion opposite the first portion, and a middle portion disposed between the first and second portions. The second portion of each of the first and second branches defines an axle opening. The axle openings of the first and second branches are aligned with each other. The first portion initially extends from the main portion toward the middle portion in a first direction having a vector component directed away from a plane defined by the mounting surface. The second portion initially extends from the middle portion in a second direction having a vector component directed toward the plane defined by the mounting surface. The first portions are closer to each other than the second portions are to each other. The kingpin is disposed within the first and second openings and couples the main portion to the baseplate. The at least one resilient bushing is disposed along the kingpin. The wheel has a central axis and is disposed between the second portions of the first and second branches such that the central axis is aligned with the axle openings.

In some implementations, the axle openings are disposed opposite the plane defined by the mounting surface from the middle portion. In some implementations, the axle openings are aligned with the plane defined by the mounting surface.

In some implementations, a brace extends between the middle portions of the first and second branches.

In some implementations, the at least one bushing includes a first bushing and a second bushing. The first bushing is disposed along the kingpin between the main portion and the baseplate. The second bushing is disposed along the kingpin adjacent a surface of the main portion opposite the first bushing.

In some implementations, the system further includes a shock absorber.

In some implementations, the baseplate and hanger comprise metal. In some implementations, the metal comprises aluminum.

In some implementations, the at least one bushing comprises a polymer.

In some implementations, at least one of the first branch and the second branch is hollow for extending wire therethrough.

In some implementations, the wheel includes motor.

In some implementations, the system further includes a battery that is in electrical communication with the motor.

In some implementations, the system further includes a Bluetooth control system for controlling the motor.

In some implementations, the wheel has a diameter in the range of 10-13 inches.

BRIEF DESCRIPTION OF DRAWINGS

Example features and implementations are disclosed in the accompanying drawings. However, the present disclosure is not limited to the precise arrangements and instrumentalities shown.

DETAILED DESCRIPTION

Figure 1:
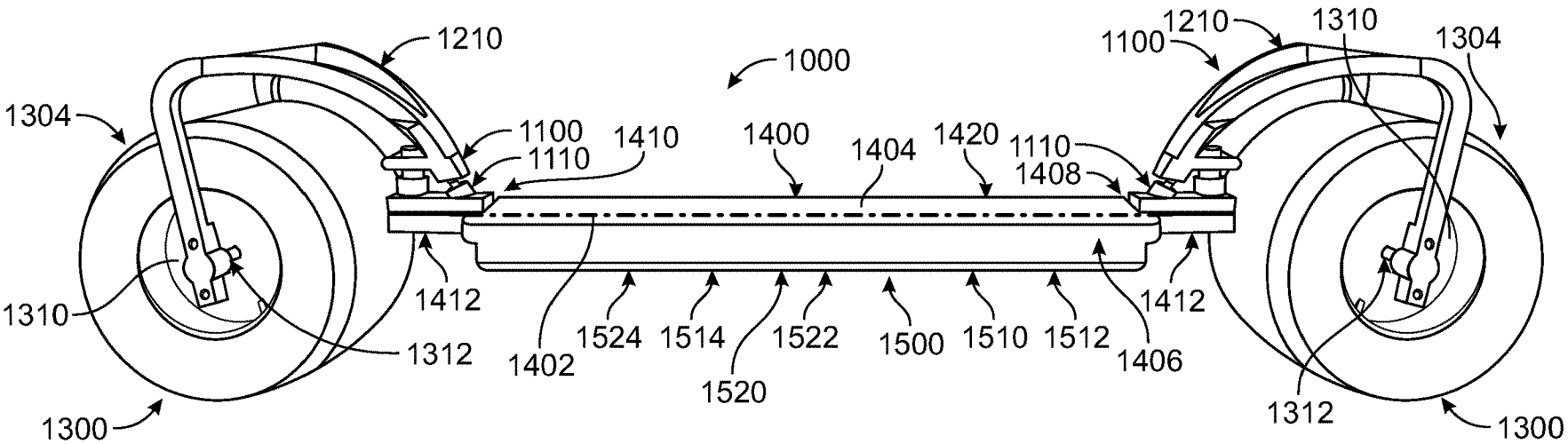
FIG. 1 is a side view of an electric skateboard, in accordance with one implementation.

The devices, systems, and methods disclosed herein provide for a truck configured to be used with a skateboard. The truck includes many of the traditional features of a skateboard truck such that the truck controls and carves like a traditional skateboard. However, the trucks disclosed herein are coupled to the top surface of the skateboard and include arcuately shaped branch portions that extend beyond the ends of the skateboard. Because the branch portions extend beyond the ends of the skateboard, a larger wheel can be coupled to the branch portions of the skateboard deck without the larger wheel causing the skateboard to be too far off of the ground. The truck is configured to couple a single wide wheel with a large diameter to the front and back of the board. The large diameter and width of the single front wheel and single back wheel provide stability to the skateboard. The large diameter wheels also allow for a hub motor to be disposed within the wheel.

Various implementations include a truck configured to be used with a skateboard. The truck includes a baseplate, a hanger, a kingpin, and at least one bushing. The baseplate has a mounting surface and defines a pivot cup and a first opening. The mounting surface defines one or more fastener openings. The hanger includes a main portion, a first branch, and a second branch. The main portion includes a pivot pin and defines a second opening. At least a portion of the pivot pin is disposed within the pivot cup. The first branch and a second branch each have a separate curved longitudinal axis, a first portion coupled to the main portion, a second portion opposite the first portion, and a middle portion disposed between the first and second portions. The second portion of each of the first and second branches defines an axle opening. The axle openings of the first and second branches are aligned with each other. The first portion initially extends from the main portion toward the middle portion in a first direction having a vector component directed away from a plane defined by the mounting surface. The second portion initially extends from the middle portion in a second direction having a vector component directed toward the plane defined by the mounting surface. The first portions are closer to each other than the second portions are to each other. The kingpin is disposed within the first and second openings and couples the main portion to the baseplate. The at least one resilient bushing is disposed along the kingpin.

Various other implementations include a system that includes a truck as described above and a wheel. The wheel has a central axis and is disposed between the second portions of the first and second branches of the truck such that the central axis of the wheel is aligned with the axle openings.

Various other implementations include a skateboard that includes at least one truck as described above, a wheel as described above, and a board. The board has a longitudinal axis, a top surface, a bottom surface opposite and spaced apart from the top surface, a first end, and a second end opposite and spaced apart from the first end along the longitudinal axis. The at least one truck is coupled to the top surface of the board adjacent either the first end or the second end of the board such that the mounting surface abuts the top surface of the board.

Figure 2:
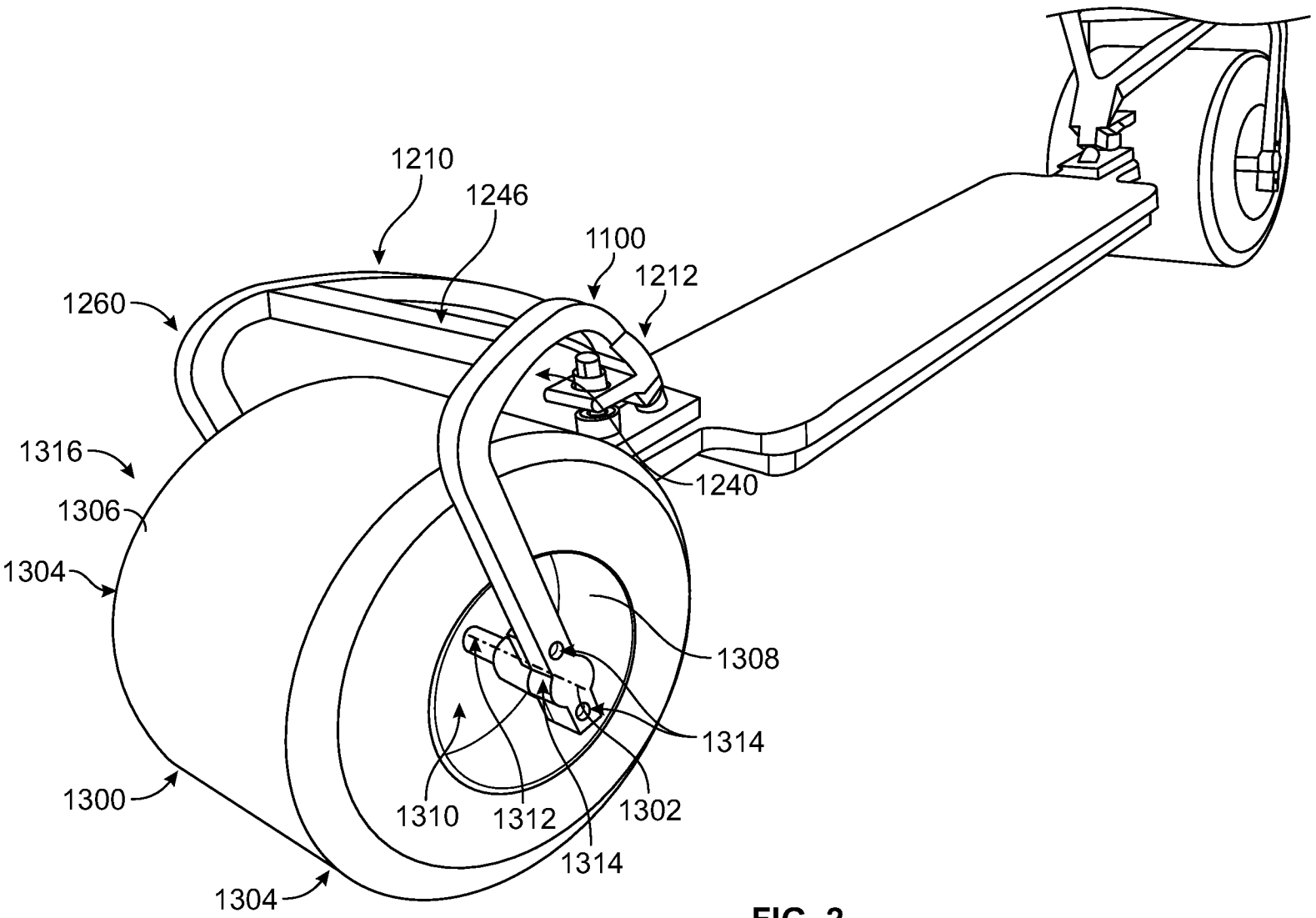
FIG. 2 is a perspective view of the electric skateboard of FIG. 1.

FIGS. 1 and 2 show an electric skateboard 1000 that includes two trucks 1100, two wheels 1300, and a board 1400. Each truck 1100 includes a baseplate 1110, a pivot cup 1130, a hanger 1210, a kingpin 1290, two resilient bushings 1296, 1297, and a nut 1298.

Figure 3:
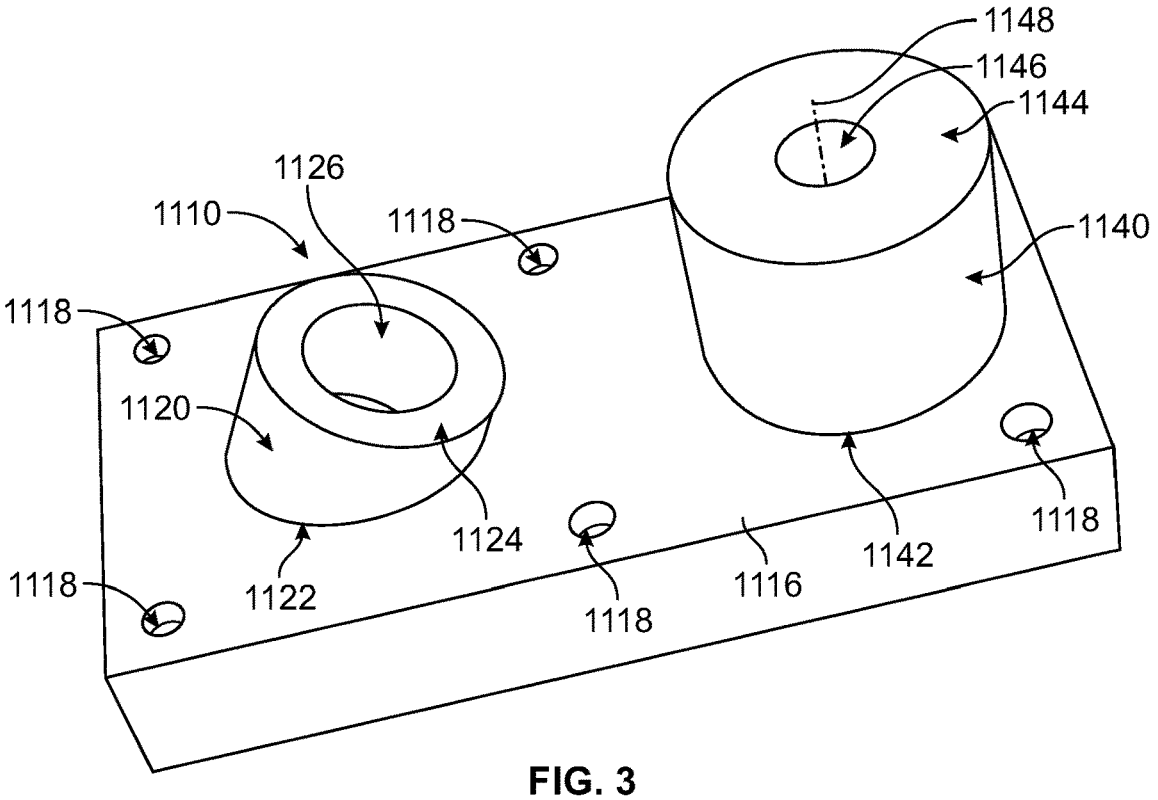
FIG. 3 is a detailed perspective view of the top of a baseplate of the electric skateboard of FIG. 1.
Figure 4:
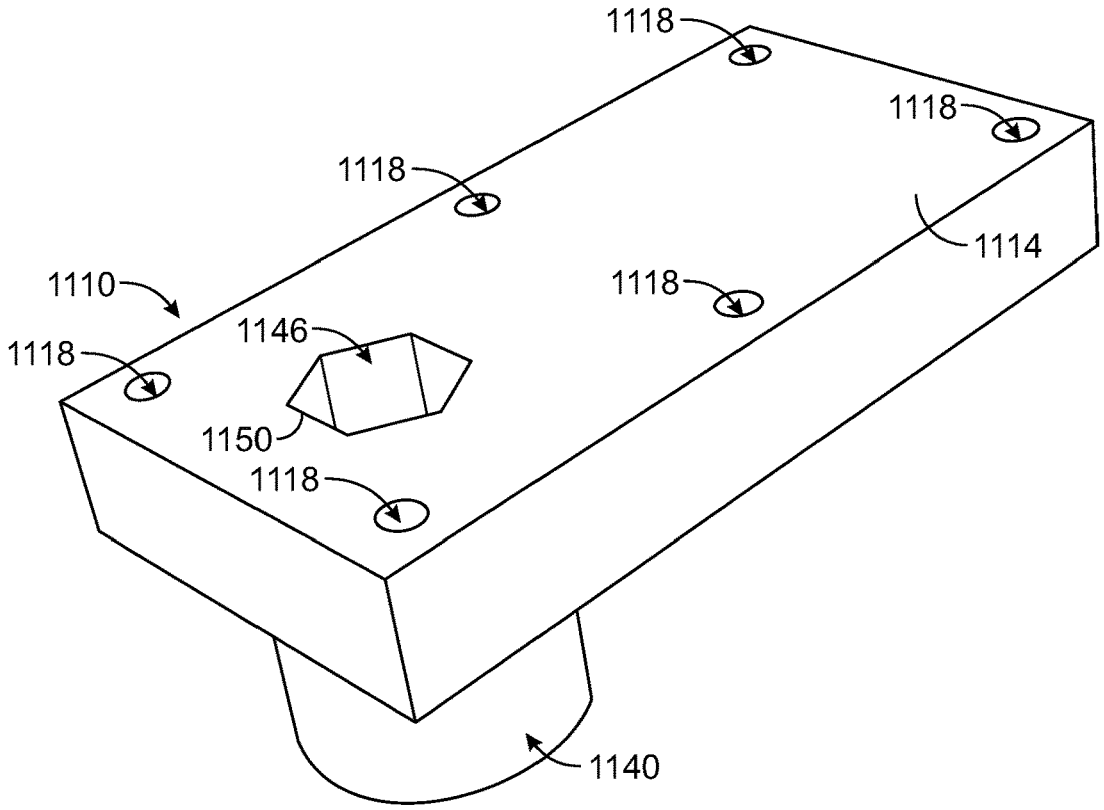
FIG. 4 is a detailed perspective view of the bottom of the baseplate of FIG. 3.

The baseplate 1110 is shown in FIGS. 3 and 4. The baseplate 1110 includes a mounting block 1112, a pivot cup protrusion 1120, and a kingpin protrusion 1140. The mounting block 1112 has a first surface 1114 (also referred to herein as "the mounting surface") and a second surface 1116 opposite and spaced apart from the mounting surface 1114. The mounting surface 1114 shown in FIGS. 3 and 4 defines six fastener openings 1118 that extend from the mounting surface 1114 to the second surface 1116, but in other implementations, the mounting surface defines any number of fastener openings.

The pivot cup protrusion 1120 has a first end 1122 and a second end 1124 spaced apart from the first end 1122. The first end 1122 of the pivot cup protrusion 1120 is integrally coupled to the second surface 1116 of the mounting block 1112. The surface of the second end 1124 of the pivot cup protrusion 1120 defines a pivot cup opening 1126 which extends partially through the pivot cup protrusion 1120. The pivot cup 1130 is disposed within the pivot cup opening 1126 of the pivot cup protrusion 1120.

The pivot cup 1130 is a hollow sleeve defining an opening at one end. The pivot pin 1218 is disposed within the opening of the pivot cup 1130, as discussed below. The pivot cup 1130, shown best in FIG. 5, comprises urethane, but in other implementations, the pivot cup comprises urethane, rubber, plastic, or any combination thereof.

Although the surface of the second end 1124 of the pivot cup protrusion 1120 shown in FIGS. 3 and 4 is at a 30-degree angle relative to second surface 1116 of the mounting block 1112, in other implementations, the surface of the second end of the pivot cup protrusion is angled relative to the second surface of the mounting block at any angle between 0 and 180 degrees. And although the pivot cup opening 1126 is also at a 30-degree angle relative to the second surface 1116 of the mounting block 1112, in other implementations, the angle of the pivot cup opening can be the same or different than the angle of the first end of the pivot cup protrusion and/or at any angle between 0 and 180 degrees relative to the second surface of the mounting block. Although the pivot cup opening 1126 shown in FIGS. 3 and 4 extends only partially through the pivot cup protrusion 1120, in other implementations, the pivot cup opening can extend to the first pivot cup protrusion end, partially into the mounting block, or through the mounting block.

The kingpin protrusion 1140 has a first end 1142 and a second end 1144 opposite and spaced apart from the first end 1142 of the kingpin protrusion 1140. The first end 1142 of the kingpin protrusion 1140 is integrally coupled to the second surface 1116 of the mounting block 1112 such that the second end 1144 of the kingpin protrusion 1140 is opposite and spaced apart from the second surface 1116 of the mounting block 1112. The surface of the second end 1144 of the kingpin protrusion 1140 defines a first kingpin opening 1146. The first kingpin opening 1146 has a central axis 1148 and extends through the kingpin protrusion 1140, through the mounting block 1112, and to the mounting surface 1114. The mounting surface 1114 of the mounting block 1112 defines a hexagonal recess 1150 around the first kingpin opening 1146 that extends partially through the mounting block 1112.

In some implementations, the inner surface of the first kingpin opening includes a plurality of radially inwardly extending protrusions circumferentially spaced around the first opening that are engageable with a plurality of corresponding radially outwardly extending kingpin protrusions. In other implementations, the inner surface of the first kingpin opening includes a plurality of threads such that a kingpin can be threaded into the first kingpin opening to couple the kingpin to the baseplate. In other implementations, the kingpin protrusion is not integrally coupled to the mounting block and is mechanically coupled to the mounting block with fasteners or any other physical coupling capable of securing the kingpin protrusion on the mounting block such that the kingpin protrusion is able to support the kingpin and couple the hanger to the mounting block. In other implementations, the pivot cup protrusion is not integrally coupled to the mounting block and is mechanically coupled to the mounting block with fasteners or any other physical coupling capable of retaining the pivot cup and withstanding the forces applied to the pivot cup protrusion in use.

Figure 6:
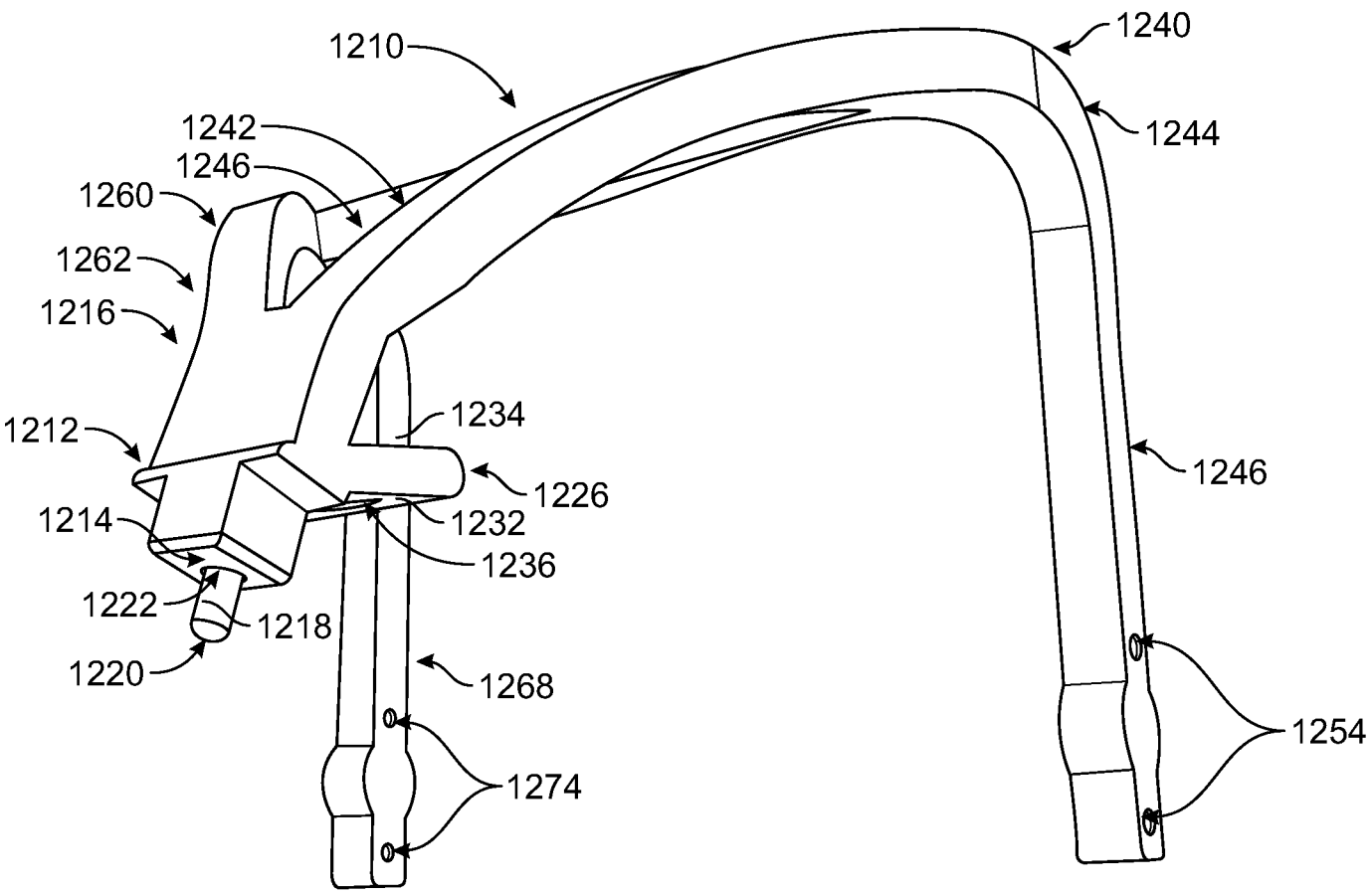
FIG. 6 is a perspective view of the top of a hanger of the electric skateboard of FIG. 1.
Figure 7:
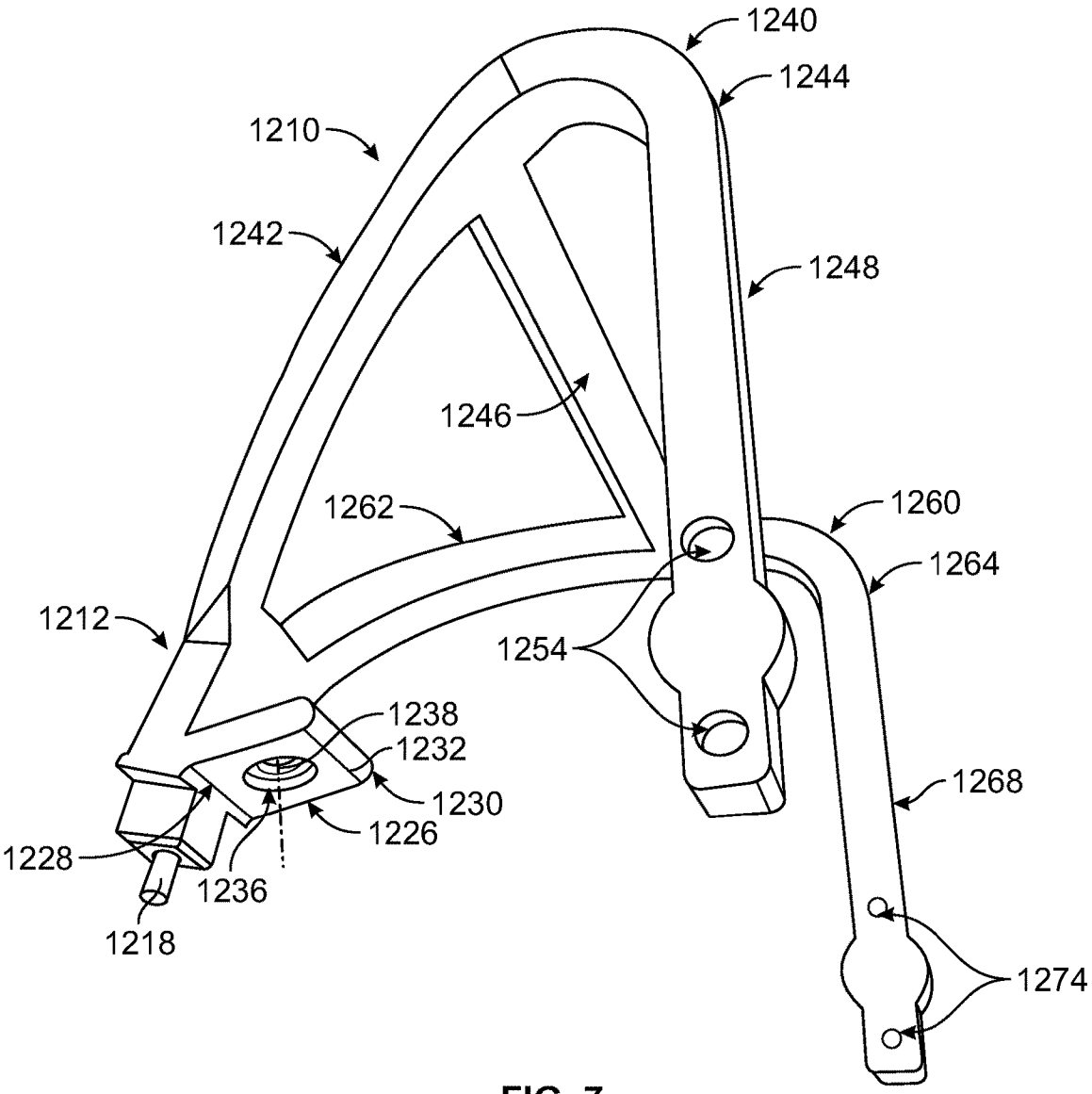
FIG. 7 is a perspective view of the bottom of the hanger of FIG. 6.
Figure 8:
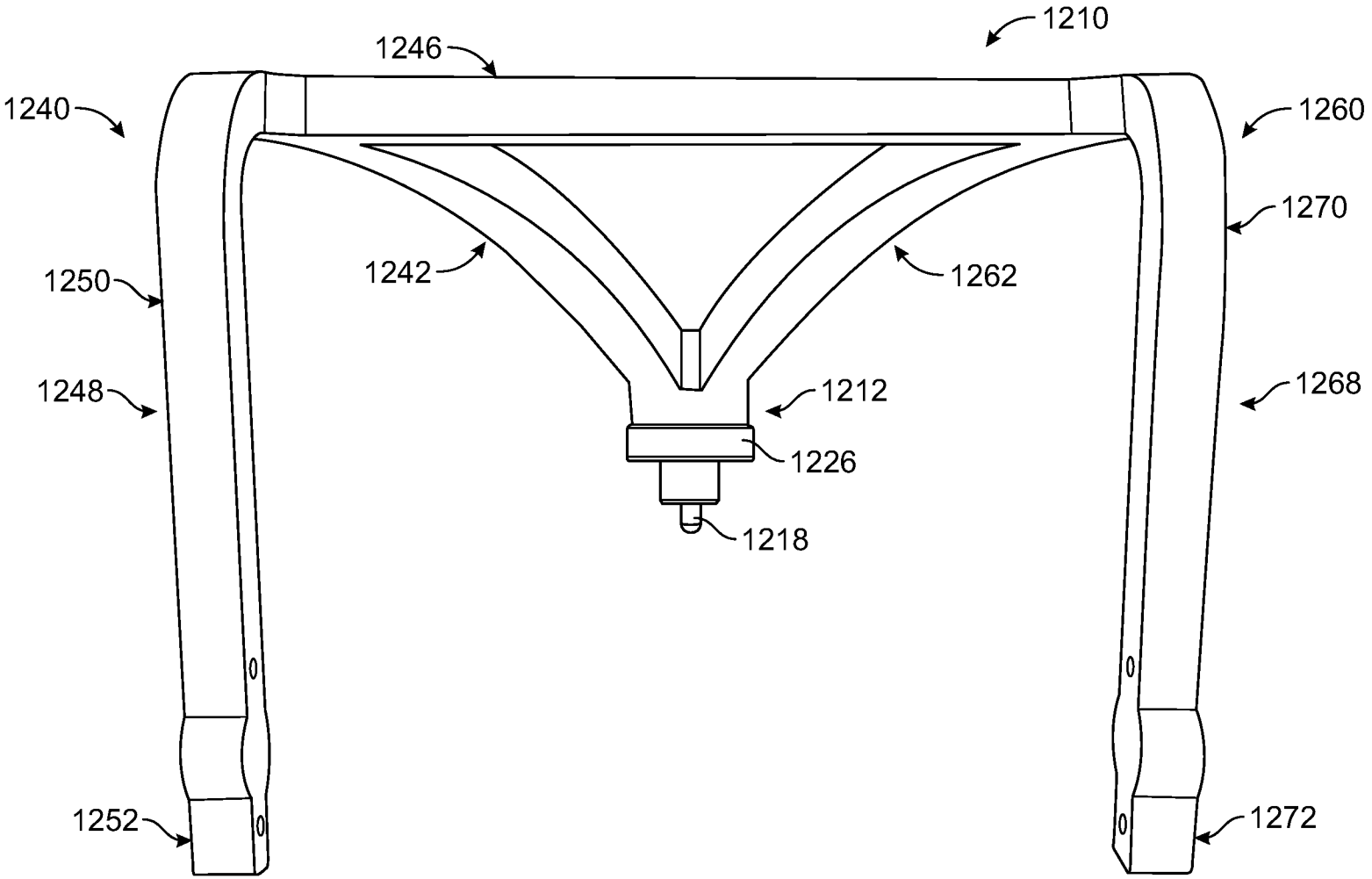
FIG. 8 is a front view of the hanger of FIG. 6.

FIGS. 6-8 show the hanger 1210. The hanger 1210 includes a main portion 1212, a pivot pin 1218, a first branch 1240, a second branch 1260, and a central plane 1280. The main portion 1212 has a first main portion end 1214 and a second main portion end 1216 opposite and spaced apart from the first main portion end 1214. The pivot pin 1218 extends from the first main portion end 1214.

The pivot pin 1218 is a cylindrical protrusion and has a first pivot pin end 1220 and a second pivot pin end 1222 opposite and spaced apart from the first pivot pin end 1220. The second pivot pin end 1222 is integrally coupled and formed to the first main portion end 1214. As seen in FIGS. 6-8, the first pivot pin end 1220 is removably and pivotably disposable within the pivot cup 1130. The first pivot pin end 1220 is pivotable about a pivot point 1224 when the first pivot pin end 1220 is disposed within the pivot cup 1130. A user can carve and turn the skateboard 1000 by shifting the user's weight on the skateboard 1000 to cause the hanger 1210 to pivot about the pivot point 1224 relative to the baseplate 1110 and board 1400.

The main portion 1212 further includes a main portion protrusion 1226 on a surface that extends between the first main portion end 1214 and the second main portion end 1216. The main portion protrusion 1226 has a first end 1228 and a second end 1230 opposite and spaced apart from the first end 1228. The first end 1228 of the main portion protrusion 1226 is integrally coupled to the surface of the main portion 1212 that extends between the first main portion 1214 and the second main portion end 1216. The main portion protrusion 1226 also has a first surface 1232 and a second surface 1234 opposite and spaced apart from the first surface 1232. Both the first surface 1232 and the second surface 1234 extend between the first end 1228 and the second end 1230 of the main portion protrusion 1226 at a 120-degree angle relative to the surface of the main portion 1212.

The first surface 1232 of the main portion protrusion 1226 defines a second kingpin opening 1236. The second kingpin opening 1236 has a central axis 1238 and extends from the first surface 1232 of the main portion protrusion 1226 to the second surface 1234 of the main portion protrusion 1226. When the pivot pin 1218 is disposed within the pivot cup 1130, the first kingpin opening 1146 and the second kingpin opening 1236 are alignable such that the central axis of the first kingpin opening 1146 and the central axis of the second kingpin opening 1236 are positionable coaxially. When the central axis of the first kingpin opening 1146 and the second kingpin opening 1236 are coaxial, the kingpin 1290 is disposed within the first kingpin opening 1146 and the second kingpin opening 1236. As discussed below, the kingpin 1290 couples the hanger 1210 to the baseplate 110, and the pivot pin 1218 being disposed within the pivot cup 1130 keeps the hanger 1210 and baseplate 110 aligned.

The first and second branches of the hanger 1240,1260 extend from the second end 1216 of the main portion 1212. The pivot point 1224 of the pivot pin 1218 and the central axis of the second kingpin opening 1236 define the central plane 1280. The first and second branches 1240,1260 have substantially the same structure as each other and are substantially mirrored across the central plane 1280. Each of the first and the second branches 1240,1260 have a separate curved longitudinal axis, a first portion 1242,1262, a second portion 1248,1268 opposite the first portion 1242,1262, and a middle portion 1244,1264 disposed between the first portions 1242,1262 and second portions 1248,1268. The term "axis", as used herein, can mean any line including straight lines, curved lines, bent lines, or any other shaped lines.

Each first portion 1242,1262 initially extends from the second main portion end 1216 toward each middle portion 1244,1264 in a first direction having a vector component directed away from a plane defined by the mounting surface 1114. The first portions 1242,1262 of the first and second branches 1240,1260 extend equally away from the central plane 1280 as each first portion 1242,1262 extends in the first direction. Each first portion 1242,1262 shown in FIGS. 6-8 extends from the second main portion end 1216 such that the first direction is at a 60-degree angle relative to the second surface 1234 of the main portion protrusion 1226, but in other implementations, the first portion extends from the second end of the main portion such that the first direction is at any angle between 0 and 90 degrees relative to the second surface of the main portion protrusion.

Each middle portion 1244,1264 is integrally disposed between each first portion 1242,1262 and each second portion 1248,1268. A brace 1246 extends between the middle portions 1244,1264 of the first and second branches 1240,1260.

Each second portion 1248,1268 is located opposite the respective branch from each first portion 1242,1262 and has a first end 1250, 1270 and a second end 1252, 1272 opposite and spaced apart from the first end 1250, 1270. The first end 1250, 1270 of each second portion 1248,1268 is integrally coupled to the middle portion 1244,1264. The first end 1250, 1270 of the second portion 1248, 1268 initially extends from the middle portion 1244,1264 to the second end 1252, 1272 of the second portion 1248,1268 in a second direction having a vector component directed toward the plane defined by the mounting surface 1114. As each second portion 1248,1268 extends in the second direction, the distance between each second portion 1248,1268 and the central plane 1280 stays substantially the same. The first portions 1242,1262 are closer to each other than the second portions 1248,1268 are to each other.

The second end 1252, 1272 of each second portion 1248,1268 defines an axle openings 1254, 1274 that extends through the second end 1252, 1272 of each second portion 1248,1268. Each axle opening 1254, 1274 is perpendicular to the central plane 1280. The axle openings 1254, 1274 of each of the first branch 1240 and second branch 1260 are axially aligned with each other and are disposed opposite the plane defined by the mounting surface 1114 from the middle portion 1244,1264 of their respective branches and are configured for mounting the hub motor 1310 and subsequently the wheels 1300 via fasteners. However, in some implementations, the axle openings are aligned with the plane defined by the mounting surface. In other implementations, the axle openings of each of the first and second branches are axially aligned with each other and are disposed on the same side of the plane defined by the mounting surface as the middle portion of their respective branches.

The first branch 1240 is hollow to allow wires to extend from the axle opening 1254, through the first branch 1240, and to the board 1400 and electronics compartment 1500, but in other implementations, both the first and second branches are hollow or both the first and second branches are not hollow.

The baseplate 1110 and hanger 1210 comprise aluminum, but in some implementations, the baseplate and/or hanger can comprise any material such as steel, titanium, any metal, any alloy, carbon fiber, a polymer, or any combination thereof. Although a brace extends between the middle portions of the first and second branches, in other implementations, any number of braces extend between the first portions, the middle portions, and/or the second portions of the first and second branches. In other implementations, two or more braces create an "X" shape. In some implementations, no braces are included. In other implementations, a fender is removably couplable to the top of the baseplate and/or hanger.

The kingpin 1290 is a bolt having a shaft 1291 and a head 1294. The shaft 1291 of the kingpin 1290 has a first kingpin shaft end 1292 and a second kingpin shaft end 1293 opposite and spaced apart from the first kingpin shaft end 1292. The head 1294 is a hex head and is coupled to the first kingpin shaft end 1292, and at least a portion of the second end of the kingpin shaft 1293 defines threads. The shaft 1291 of the kingpin 1290 is disposed within the first and second kingpin openings 1146, 1236 such that the head 1294 of the kingpin 1290 is disposed within the hexagonal recess 1148 and abuts the first kingpin opening 1146, and at least a portion of the threaded portion of the shaft 1291 extends through the second kingpin opening 1236. The head 1294 of the kingpin 1290 abuts the sides of the hexagonal recess 1148 such that the head 1294 of the kingpin 1290 is flush with or recessed below the mounting surface 1116 of the mounting block 1112. The diameter of the shaft 1291 of the kingpin 1290 is smaller than the diameter of the first and second kingpin openings 1146, 1236 to allow for movement between the shaft 1291 of the kingpin 1290 and the first and second kingpin openings 1146, 1236.

In some implementations, the entire outer surface of the shaft of the kingpin defines threads. In other implementations, the head of the kingpin is not a hex head and is any shape head. In other implementations, the outer surface of the head of the kingpin includes a plurality of radially extending kingpin protrusions circumferentially spaced around the outer surface of the head of the kingpin that are engageable with a plurality of corresponding radially extending kingpin protrusions on the inner surface of the first kingpin opening. In other implementations, the shaft of the kingpin includes a plurality of radially extending kingpin protrusions circumferentially spaced around the outer surface of the shaft of the kingpin that are engageable with a plurality of corresponding radially extending kingpin protrusions on the inner surface of the first and/or second kingpin opening.

Figure 5:
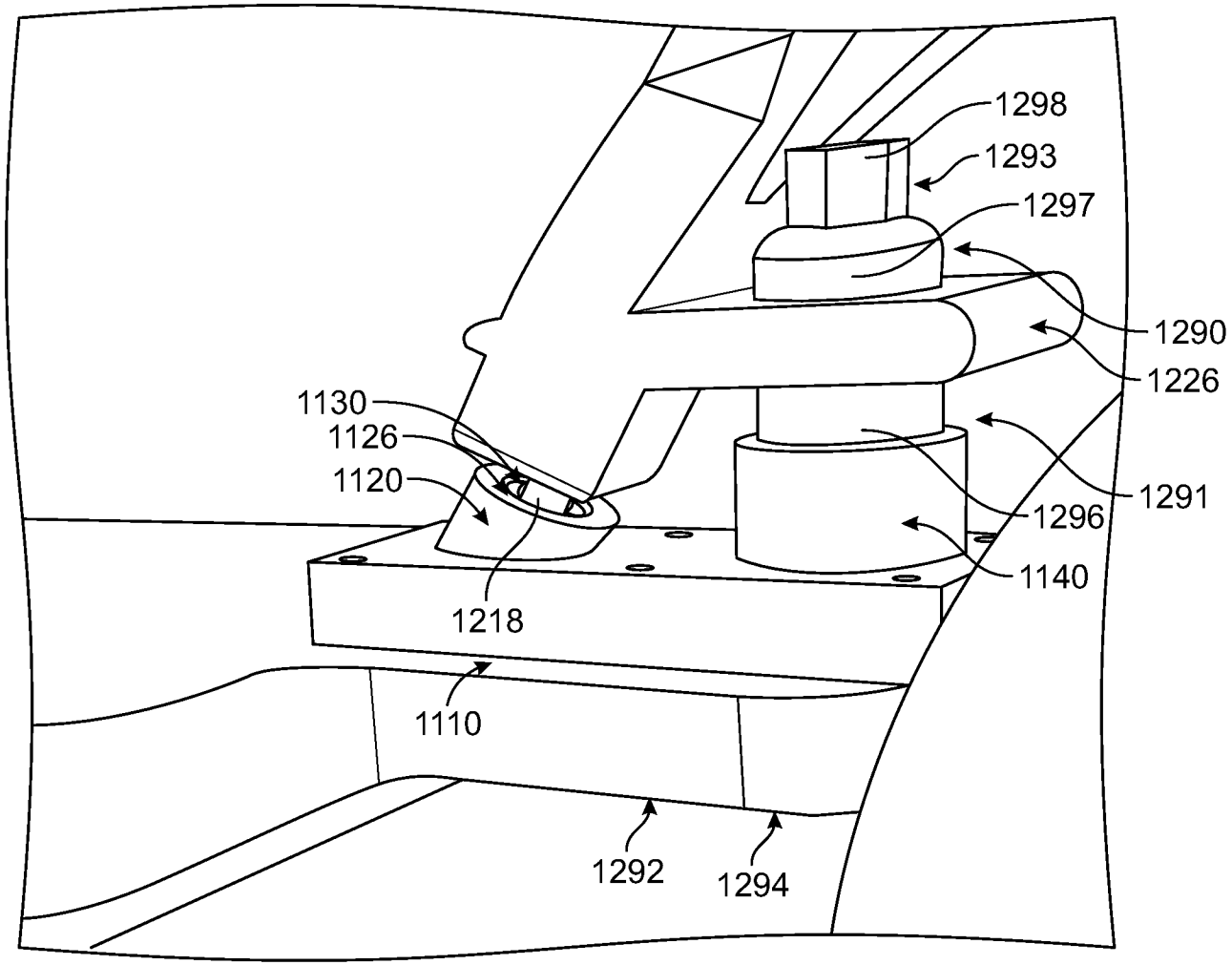
FIG. 5 is a detailed view of the baseplate and hanger of the electric skateboard of FIG. 1.

The first and second resilient bushings 1296, 1297 are annular shaped bodies having an opening. The kingpin 1290 extends through the openings defined by each of the first and second resilient bushings 1296, 1297. As shown in FIG. 5, the first resilient bushing 1296 is disposed between the second end 1144 of the kingpin protrusion 1140 and the first surface 1232 of the main portion protrusion 1226, and the second resilient bushing 1297 is disposed adjacent the second surface 1234 of the main portion protrusion 1226 such that the second resilient bushing 1297 is opposite the first resilient bushing 1296. The nut 1298 is threaded onto the threaded portion of the second end 1293 of the shaft 1291 of the kingpin 1290 adjacent a side of the second resilient bushing 1297 opposite the second surface 1234 of the main portion protrusion 1226. The nut 1298 and the kingpin 1290 secure the first resilient bushing 1296, main portion 1212, and second resilient bushing 1297 to the baseplate 1110. The resilient bushings 1296, 1297 have a degree of resiliency that allows for movement of the kingpin 1290 within the kingpin openings 1146, 1236 such that the hanger 1210 can move relative to the baseplate 1110 by compressing the resilient bushings 1296, 1297 as a user applies more weight to one side of the board 1400 than the other side of the board 1400. The degree of resiliency of the resilient bushings 1296, 1297 affects the amount of force a user must apply to one of the side of the board 1400 in order to cause the skateboard 1000 to turn.

The resilient bushings 1296, 1297 comprise plastic (ie. polyurethane), rubber, or any combination thereof. In some implementations, the resilient bushing is an annular, frusto-conical shape. In other implementations, at least a portion of the resilient bushing includes a step with a smaller outer diameter than the other portion of the resilient bushing. In some implementations, the kingpin, nut, and resilient bushing assembly includes only one resilient bushing or three or more resilient bushings. In some implementations, the kingpin, nut, and resilient bushing assembly further includes a locking device to prevent the nut from backing off of the threaded portion of the kingpin, such as locking washers, a nyloc nut, a jam nut, thread filler, or any other device known to prevent unintentional movement of the nut relative to the kingpin. In some implementations, the kingpin, nut, and resilient bushing assembly further includes one or more washers.

As previously mentioned, each truck 1100 includes axle openings 1254, 1274 for mounting a wheel 1300. Each wheel 1300 has a central axis 1302, an annular outer portion 1304, and a hub motor 1310. The annular outer portion 1304 has a radially outer surface 1306, and a radially inner surface 1308. The hub motor 1310 is disposed within the annular outer portion 1304 adjacent the radially inner surface 1308 of the wheel 1300 and includes an axle 1312 disposed along the central axis 1302 of the wheel 1300. The axle 1312 includes a first end 1314 and a second end 1316 opposite and spaced apart from the first end 1314. The wheel 1300 is rotatably coupled to the truck 1100 by coupling the first end 1314 and the second end 1316 of the axle 1312 to the axle openings 1254, 1274 of the second portions 1248, 1268 of the first and second branches 1240, 1260 of the hanger 1210 via fasteners such that the wheel 1300 is disposed between the second portions 1248, 1268 of the first and second branches 1240, 1260. The axle 1312 of the hub motor 1310 is fixedly coupled to the truck 1100 such that the rotational movement of the hub motor 1310 causes the annular outer portion 1304 of the wheel 1300 to rotate relative to the axle 1312 and truck 1100. In other implementations, the hub motor is not disposed within the annular outer portion of the wheel but is instead separately mounted to the truck or board to drive a rotatable axle and/or wheel either directly or indirectly through a transmission assembly.

The wheel 1300 has a diameter in the range of 10-13 inches, an outer surface width of 6-12 inches, and a rim diameter in the range of 4-8 inches. The hub motor 1310 has a power of 1,500 watts, but in some implementations, hub motors with a power ranging from 1,000 to 2,000 watts.

The board 1400 has a longitudinal axis 1402, a top surface 1404, a bottom surface 1406 opposite and spaced apart from the top surface 1404, a first end 1408, and a second end 1410 opposite and spaced apart from the first end 1408 along the longitudinal axis 1402. The top surface 1404 of the board 1400 defines a plurality of faster openings 1412 extending from the top surface 1404 to the bottom surface 1406. A first group of fastener openings 1412 defined by the board 1400 are located adjacent the first end 1408 of the board 1400, and a second group of fastener openings 1412 defined by the board 1400 are located adjacent the second end 1410 of the board 1400. Each of the first and second group of fastener openings 1412 defined by the board 1400 are alignable with the fastener openings 1118 defined by the baseplate 1110 of a truck 1100. The baseplate 1110 of the truck 1100 is coupled to the board 1400 with a plurality of fasteners 1414 extending through the aligned fastener openings in the baseplate and the first group of fastener openings 1412 in the board 1400. The baseplate 1110 of another truck 1100 is coupled to the board 1400 with a plurality of fasteners 1414 extending through the aligned fastener openings 1118 in the baseplate 1110 and the second group of fastener openings 1412 in the board 1400. The branches 1240, 1260 of each of the trucks 1100 extend beyond the first and second ends 1408, 1410 of the board 1400, respectively. When a user is on the top surface 1404 of the board 1400, the hanger 1210 of each of the trucks 1100 flexes slightly which allows for easier control.

The top surface 1404 of the board 1400 further includes a frictional coating 1420 that extends over the entirety of the top surface 1404 of the board 1400 to provide traction between the top surface 1404 of the board 1400 and a user when in use. The frictional coating 1420 is applied to the top surface 1404 of the board 1400 via an adhesive, but in other implementations, the frictional coating is integrally formed with the board.

In other implementations, the board further includes foot straps coupled to the top surface to secure the feet of a user when riding the skateboard. In other implementations, the board includes at least one foot strap that is integrally formed with the top surface of the board, mechanically coupled to the top surface of the board with fasteners, or any other physical coupling capable of coupling at least one foot strap to the top surface of the board such that the physical coupling can couple the feet of a user to the board and withstand any potential forces applied by the feet of the user during riding.

The board 1400 further includes an electronics compartment 1500 coupled to the bottom surface 1406 of the board 1400. The electronics compartment 1500 houses a battery system 1510 and a motor controller 1520. The battery system 1510 includes a 15S4P lithium ion battery pack 1512 and a battery management system 1514. The motor controller 1520 includes a dual motor controller 1522 and includes a radio frequency ("RF") module 1524 which receives radio signals from an external remote (not shown). The external remote transmits radio signals to the RF module 1524 on the motor controller 1520. The motor controller 1520 powers the hub motors 1310 depending on the radio signal from the remote. The remote is capable of transmitting a variety of radio signals that can vary the direction and speed at which the wheels rotate.

The battery system 1510 and motor controller 1520 are in electrical communication with each hub motor 1310. The wires connecting the battery system 1510 and motor controller 1520 to the hub motors 1310 are disposed within the hollow first branch 1240 of each truck 1100.

In other implementations, the battery and motor controller are housed within the board. In other implementations, the microcontroller includes a Bluetooth module that is in communication with an external Bluetooth remote. In other implementations, the microcontroller includes any type of transmitter or receiver that communicates using signals of any frequency or wavelength.

Figure 9:
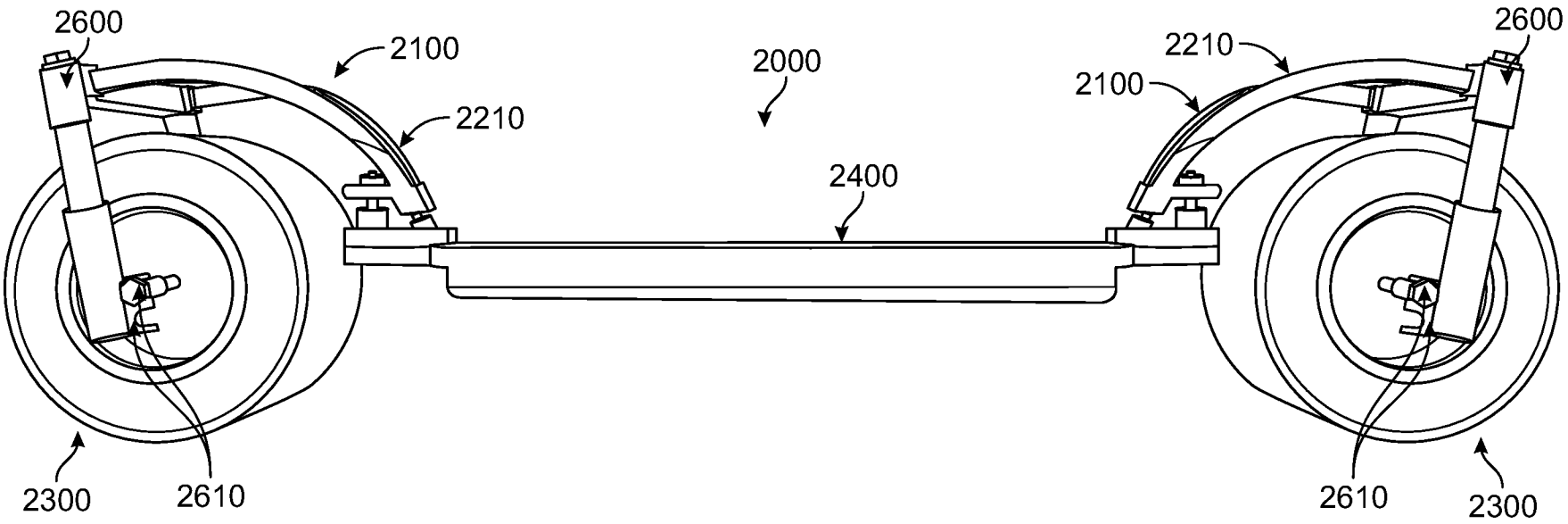
FIG. 9 is a side view of an electric skateboard, in accordance with another implementation.
Figure 10:
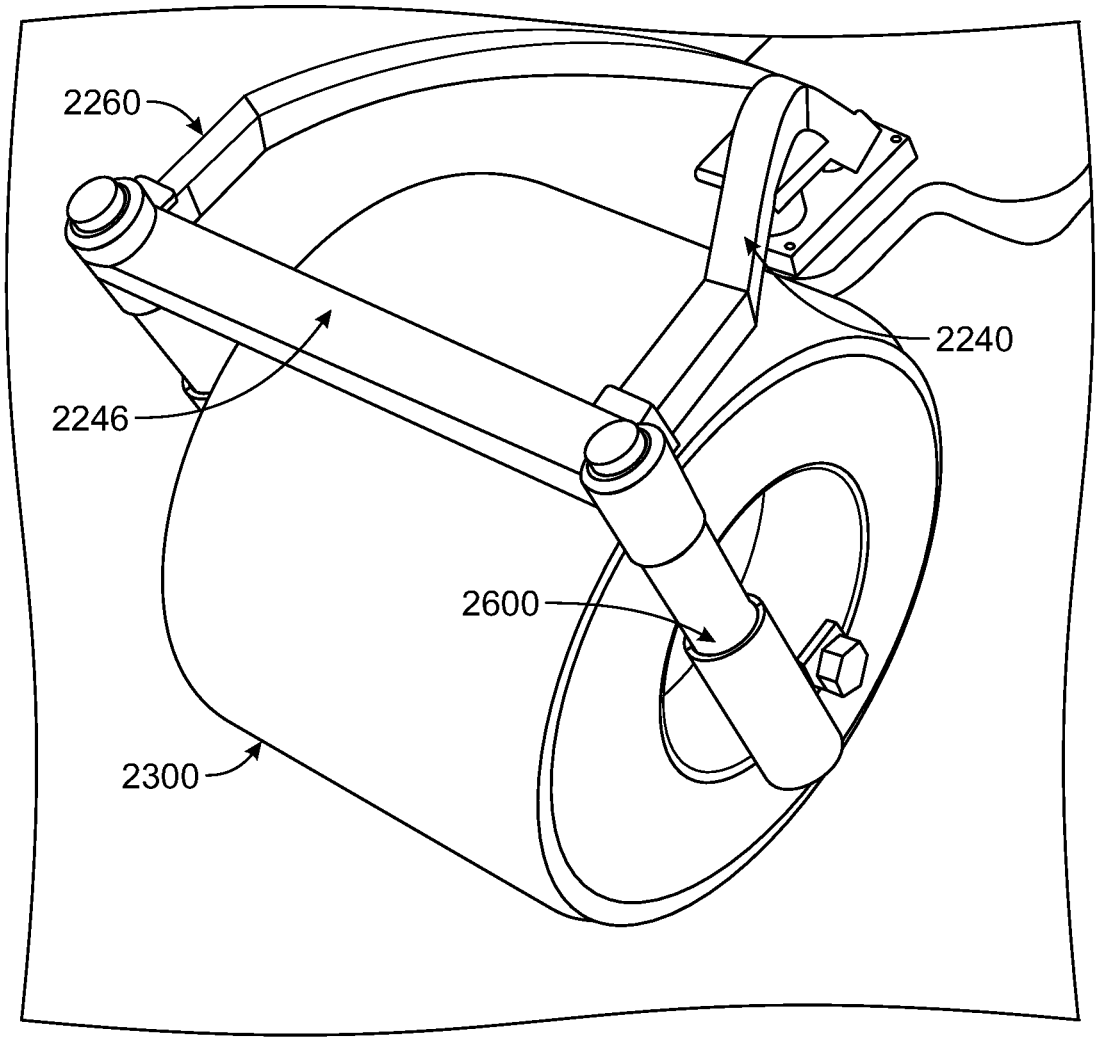
FIG. 10 is a magnified view of a truck and wheel of the electric skateboard of FIG. 9.

As shown in FIGS. 9 and 10, in another implementation, the skateboard 2000 further includes shock absorbers 2600. At least a portion of each second portion 2248, 2268 of each branch 2240, 2260 includes a shock absorber 2600. During use, the shock absorbers 2600 dampen the forces transferred from the ground to the board 2500 and help the wheels 2300 stay in contact with the ground. Each of the two shock absorbers 2600 define axle openings 2610 to allow for adjustability of the height of the trucks 2100. The shock absorbers 2600 shown in FIGS. 9 and 10 include air springs, but in other implementations, the shock absorbers include air shocks, coil shocks, or any shock absorber capable of stabilizing the skateboard 2000.

In other implementations, the shock absorber replaces the entire second portion of each of the branches and defines the axle openings. In other implementations, at least a portion of the middle portions of each of the branches includes a shock absorber. In other implementations, the shock absorber replaces the entire middle portion and second portion of each branch.

A number of implementations have been described. Nevertheless, it will be understood that various modifications may be made without departing from the spirit and scope of the claims. Accordingly, other implementations are within the scope of the following claims.

Certain terminology is used herein for convenience only and is not to be taken as a limitation on the present claims. In the drawings, the same reference numbers are employed for designating the same elements throughout the several figures. A number of examples are provided, nevertheless, it will be understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A truck configured to be used with a skateboard, the truck comprising:

a baseplate having a mounting surface and defining a pivot cup opening and a first opening, wherein the mounting surface defines one or more fastener openings;

a hanger comprising:

a main portion including a pivot pin and defining a second opening, wherein at least a portion of the pivot pin is disposed within the pivot cup opening, and a first branch and a second branch, each of the first and second branches having a separate curved longitudinal axis, a first portion coupled to the main portion, a second portion opposite the first portion, and a middle portion disposed between the first and second portions, wherein the second portion of each of the first and second branches define an axle opening and the axle openings of the first and second branches are aligned with each other, wherein the first portion initially extends from the main portion toward the middle portion in a first direction having a vector component directed away from a plane defined by the mounting surface, and the second portion initially extends from the middle portion in a second direction having a vector component directed toward the plane defined by the mounting surface, and wherein the first portions are closer to each other than the second portions are to each other;

a kingpin disposed within the first and second openings and coupling the main portion to the baseplate; and at least one resilient bushing disposed along the kingpin.

2. The truck of claim 1, wherein the axle openings are disposed opposite the plane defined by the mounting surface from the middle portion.

3. The truck of claim 1, wherein the axle openings are aligned with the plane defined by the mounting surface.

4. The truck of claim 1, wherein a brace extends between the middle portions of the first and second branches.

5. The truck of claim 1, wherein the at least one bushing includes a first bushing and a second bushing, the first bushing disposed along the kingpin between the main portion and the baseplate, and the second bushing disposed along the kingpin adjacent a surface of the main portion opposite the first bushing.

6. The truck of claim 1, further comprising a shock absorber.

7. The truck of claim 1, wherein the baseplate and hanger comprise metal.

8. The truck of claim 7, wherein the metal comprises aluminum.

9. The truck of claim 1, wherein the at least one bushing comprises a polymer.

10. The truck of claim 1, wherein at least one of the first branch and the second branch is hollow for extending wire therethrough.

11. A skateboard comprising:

at least one truck comprising:

a baseplate having a mounting surface and defining a pivot cup opening and a first opening, wherein the mounting surface defines one or more fastener openings;

a hanger comprising:

a main portion including a pivot pin and defining a second opening, wherein at least a portion of the pivot pin is disposed within the pivot cup opening, and a first branch and a second branch, each of the first and second branches having a separate curved longitudinal axis, a first portion coupled to the main portion, a second portion opposite the first portion, and a middle portion disposed between the first and second portions, wherein the second portion of each of the first and second branches define an axle opening and the axle openings of the first and second branches are aligned with each other, wherein the first portion initially extends from the main portion toward the middle portion in a first direction having a vector component directed away from a plane defined by the mounting surface, and the second portion initially extends from the middle portion in a second direction having a vector component directed toward the plane defined by the mounting surface, and wherein the first portions are closer to each other than the second portions are to each other;

a kingpin disposed within the first and second openings and coupling the main portion to the baseplate; and at least one resilient bushing disposed along the kingpin between the main portion and the baseplate, a board having a longitudinal axis, a top surface, a bottom surface opposite and spaced apart from the top surface, a first end, and a second end opposite and spaced apart from the first end along the longitudinal axis, wherein the at least one truck is coupled to the top surface of the board adjacent either the first end or the second end of the board such that the mounting surface abuts the top surface of the board; and a wheel having a central axis, the wheel being disposed between the second portions of the first and second branches such that the central axis is aligned with the axle openings.

12. The skateboard of claim 11, wherein the axle openings are disposed opposite the plane defined by the mounting surface from the middle portion.

13. The skateboard of claim 11, wherein the axle openings are aligned with the plane defined by the mounting surface.

14. The skateboard of claim 11, wherein a brace extends between the middle portions of the first and second branches.

15. The skateboard of claim 11, wherein the at least one bushing includes a first bushing and a second bushing, the first bushing disposed along the kingpin between the main portion and the baseplate, and the second bushing disposed along the kingpin adjacent a surface of the main portion opposite the first bushing.

16. The skateboard of claim 11, wherein the at least one truck further comprises a shock absorber.

17. The skateboard of claim 11, wherein the baseplate and hanger comprise metal.

18. The skateboard of claim 17, wherein the metal comprises aluminum.

19. The skateboard of claim 11, wherein the at least one bushing comprises a polymer.

20. The skateboard of claim 11, wherein at least one of the first branch and the second branch is hollow for extending wire therethrough.

21. The skateboard of claim 11, wherein the wheel includes motor.

22. The skateboard of claim 21, further comprising a battery, wherein the battery is in electrical communication with the motor.

23. The skateboard of claim 22, wherein the battery is disposed on the bottom surface of board.

24. The skateboard of claim 11, wherein the top surface of the board includes a frictional coating.

25. The skateboard of claim 11, wherein the at least one truck further includes two trucks, and each of the two trucks has a wheel having a central axis, the wheel being disposed between the second portions of the first and second branches of each truck such that the central axis of each of the wheels is aligned with the axle openings of the first and second branches of its respective truck.

26. The skateboard of claim 21, further comprising a Bluetooth control system for controlling the motor.

27. The skateboard of claim 11, wherein the board further includes foot straps coupled to the top surface.

28. The skateboard of claim 11, wherein the wheel has a diameter in the range of 10-13 inches.

29. A system configured to be used with a skateboard, the system comprising:

a truck comprising:

a baseplate having a mounting surface and defining a pivot cup opening and a first opening, wherein the mounting surface defines one or more fastener openings, a hanger comprising:

a main portion including a pivot pin and defining a second opening, wherein at least a portion of the pivot pin is disposed within the pivot cup opening, and a first branch and a second branch, each of the first and second branches having a separate curved longitudinal axis, a first portion coupled to the main portion, a second portion opposite the first portion, and a middle portion disposed between the first and second portions, wherein the second portion of each of the first and second branches define an axle opening and the axle openings of the first and second branches are aligned with each other, wherein the first portion initially extends from the main portion toward the middle portion in a first direction having a vector component directed away from a plane defined by the mounting surface, and the second portion initially extends from the middle portion in a second direction having a vector component directed toward the plane defined by the mounting surface, and wherein the first portions are closer to each other than the second portions are to each other, a kingpin disposed within the first and second openings and coupling the main portion to the baseplate, and at least one resilient bushing disposed along the kingpin; and a wheel having a central axis, the wheel being disposed between the second portions of the first and second branches such that the central axis is aligned with the axle openings.

30. The system of claim 29, wherein the axle openings are disposed opposite the plane defined by the mounting surface from the middle portion.

31. The system of claim 29, wherein the axle openings are aligned with the plane defined by the mounting surface.

32. The system of claim 29, wherein a brace extends between the middle portions of the first and second branches.

33. The system of claim 29, wherein the at least one bushing includes a first bushing and a second bushing, the first bushing disposed along the kingpin between the main portion and the baseplate, and the second bushing disposed along the kingpin adjacent a surface of the main portion opposite the first bushing.

34. The system of claim 29, further comprising a shock absorber.

35. The system of claim 29, wherein the baseplate and hanger comprise metal.

36. The system of claim 35, wherein the metal comprises aluminum.

37. The system of claim 29, wherein the at least one bushing comprises a polymer.

38. The system of claim 29, wherein at least one of the first branch and the second branch is hollow for extending wire therethrough.

39. The system of claim 29, wherein the wheel includes motor.

40. The system of claim 39, further comprising a battery, wherein the battery is in electrical communication with the motor.

41. The system of claim 39, further comprising a Bluetooth control system for controlling the motor.

42. The system of claim 29, wherein the wheel has a diameter in the range of 10-13 inches.

* * * * *